US005383348A

United States Patent [19]

Michael et al.

[11] Patent Number: 5,383,348

[45] Date of Patent: Jan. 24, 1995

[54] PRESS COMPRISING A TRANSFER DEVICE FOR SHEET METAL PARTS

[75] Inventors: Wolfgang Michael, Göppingen; Karl Thudium, Wäschenbeuren; Peter Klemm, Stuttgart; Burkhardt Schumann, Ottenbach; Hans Hofele; Walter Rieger, both of Göppingen, all of Germany

[73] Assignee: L. Schuler GmbH, Goeppingen, Germany

[21] Appl. No.: 147,524

[22] Filed: Nov. 5, 1993

[30] Foreign Application Priority Data

Nov. 5, 1992 [DE] Germany ..... 4237313

[51] Int. Cl.[6] ..... B21D 43/05

[52] U.S. Cl. ..... 72/405

[58] Field of Search ..... 72/405, 422, 421

[56] References Cited

U.S. PATENT DOCUMENTS 4,540,087 9/1985 Mizumoto ..... 198/621
4,625,540 12/1986 Yamada et al. ..... 72/405
4,741,195 5/1988 Arai ..... 72/405

FOREIGN PATENT DOCUMENTS 62142431 2/1986 Japan .
2243134 10/1991 United Kingdom .

*Primary Examiner*—Daniel C. Crane
*Attorney, Agent, or Firm*—Evenson, McKeown, Edwards & Lenahan

[57] ABSTRACT

In a press, an individual press, a multistage press, a multistand press and similar forming facilities, transfer devices are provided for the transport of sheet metal parts in the machining stages. These transfer devices have guide strips which can be lifted and lowered in vertical guides on the press stands via adjusting devices. In each guide strip, toothed belts are arranged which are guided on deflecting rollers. The moving drive in the horizontal direction takes place from a motor-transmission device. As a result, a reduction of the mass of the movable structural members of the transfer device is achieved while the construction of the transfer device is modular.

10 Claims, 4 Drawing Sheets

PRESS COMPRISING A TRANSFER DEVICE FOR SHEET METAL PARTS

BACKGROUND AND SUMMARY OF THE INVENTION

The present invention relates to a press, an individual press, a multistage press, multistand press, transfer press, press line or similar forming machine, comprising one press slide or, if necessary, several press slides which, for the forming of sheet metal parts, can be moved up and down while interacting with the tools, and comprising a transfer device with holding devices which hold and transfer the sheet metal parts, comprising driving devices for the lifting and lowering of the holding devices and driving devices for the moving of the holding devices in the passage direction.

The transport of the sheet metal parts through presses of the above type takes place by a transfer device with a two- or three-dimensional movement of the holding devices for the sheet metal parts, with the inserting and the removal of the sheet metal parts being performed by feeders.

In U.S. Pat. No. 4,540,087, a transfer device in a transfer press is described which has two transfer bars which can be moved in three axes (three-dimensionally) and which extend horizontally and at a parallel distance from one another. In addition, the transfer device has an advancing mechanism arranged on one end of the transfer bar for generating a reciprocating movement, as well as two clamping mechanisms for the clamping and releasing movement and two stroke mechanisms for the lifting and lowering of the transfer bars.

The advancing, clamping and stroke mechanisms are each driven by a separate d.c. servomotor which are assigned to one transfer bar side; and the longitudinal, transverse and vertical strokes of the transfer bars can be varied continuously and independently of one another. The driving movements are transmitted to the drive side of the second transfer bar by a torsion bar.

U.S. Pat. No. 4,625,540 describes a transfer device in a transfer press of the two-dimensional type, in which running rails in the longitudinal dimension of the press can be lifted and lowered while being situated in front of and behind the tools. In the running rails, a frame is disposed which can be moved horizontally in the dimension of the press. Bars which extend in their length transversely with respect to the longitudinal dimension of the press and have holding devices for the sheet metal parts are arranged on the frame. In addition to the movement of the frame, the bars can be moved in a movement along the longitudinal dimension of the press. The drive of the lifting and lowering movement of the running rails and thus of the frame and the drive of the frame in the horizontal plane and of the additional movement of the bars takes place in a cam-controlled manner and thus in a restricted manner as a function of the press.

In contrast, it is an object of the invention to provide, at least with respect to the structural members of the transfer device that are to be moved, a low-mass construction which permits differing timing amounts in the subsequent machining stages or time-staggered downward and upward movements of the slides of the individual machining stages.

This and other objects are achieved by the present invention which provides a press, comprising a press frame, at least one vertically movable press slide that forms sheet metal parts while interacting with tools, and at least one transfer device with holding devices which hold and transfer the sheet metal parts through movement of the holding devices vertically and horizontally along a passage direction. Each transfer device includes at least one transport device extending in the passage direction, and vertically movable horizontal guide strips in the press frame which extend at least along a partial length of a transfer movement of the sheet metal parts and extend in front of and behind the tool or the press slide. The holding devices are displaceable in the guide strips, and each of the guide strips have structural members which receive, bear and guide the transport device. The transfer devices also include vertical guides coupled to the press frame and the guide strips, a first adjusting device coupled to the guide strips and which lifts and lowers the guide strips in the vertical guides, and a second adjusting device, separate from the first adjusting device, coupled to the transport device and which moves the transport device to thereby move the holding devices along the passage direction.

With the present invention, the utilization of a press or similar forming facility becomes more flexible. The removal of the sheet metal parts from an insertion station or from an intermediate depositing device as well as from a tool and the depositing into an intermediate depositing device or into a tool may take place separately for each individual machining stage.

The transfer device can be expanded with respect to the holding devices, for example, for double parts. One driving element for each axle as well as a separate drive for each drive side are contemplated. On each side of the press, the transport device may be a toothed belt deflected in a guide strip on which the holding device or devices are fastened. The transfer devices are constructed in the manner of modules for a successive staggered arrangement through a multistage press, press line or multistand press. In certain embodiments, the transfer device is used as an inserting and removal device (feeder). In addition to smaller overall sizes, a higher stiffness is achieved in comparison to previous feeders.

Other objects, advantages and novel features of the present invention will become apparent from the following detailed description of the invention when considered in conjunction with the accompanying drawings.

DETAILED DESCRIPTION OF THE DRAWINGS

Figure 1:
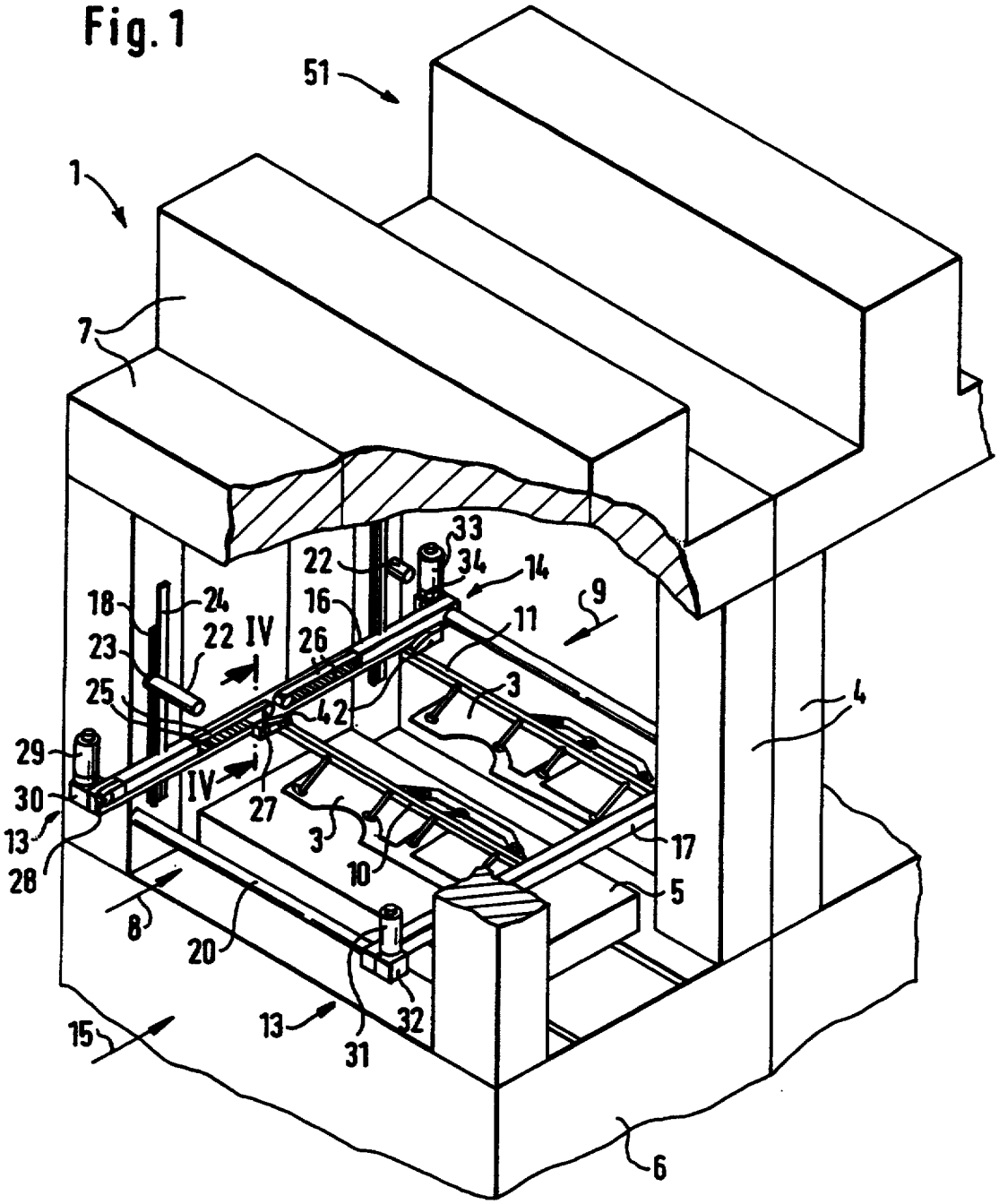
FIG. 1 is a view of a press with two transfer devices constructed according to an embodiment of the present invention.
Figure 2:
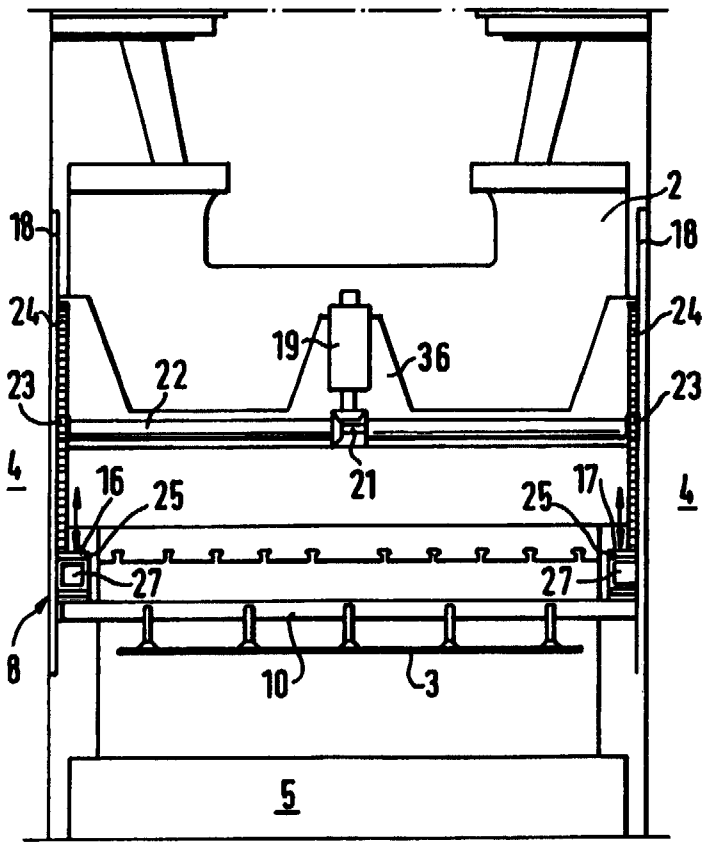

The press in FIG. 1 may be an individual press or a forming facility which is expanded by means of (multiple die) presses to form a press line, a compact press or a hybrid press. The press 1 has a head piece 7 with the press drive for the slide or slides 2 (FIG. 2). Press stands 4 are placed on a bedplate 6 of the press 1, and the head piece 7 is fitted onto these press stands 4. A sliding table 5 can be moved into the press 1. The tools can be exchanged via this sliding table 5. So that the transfer devices 8, 9 can be illustrated more clearly, the slides 2 and the tools are not shown in FIG. 1.

Figure 4:
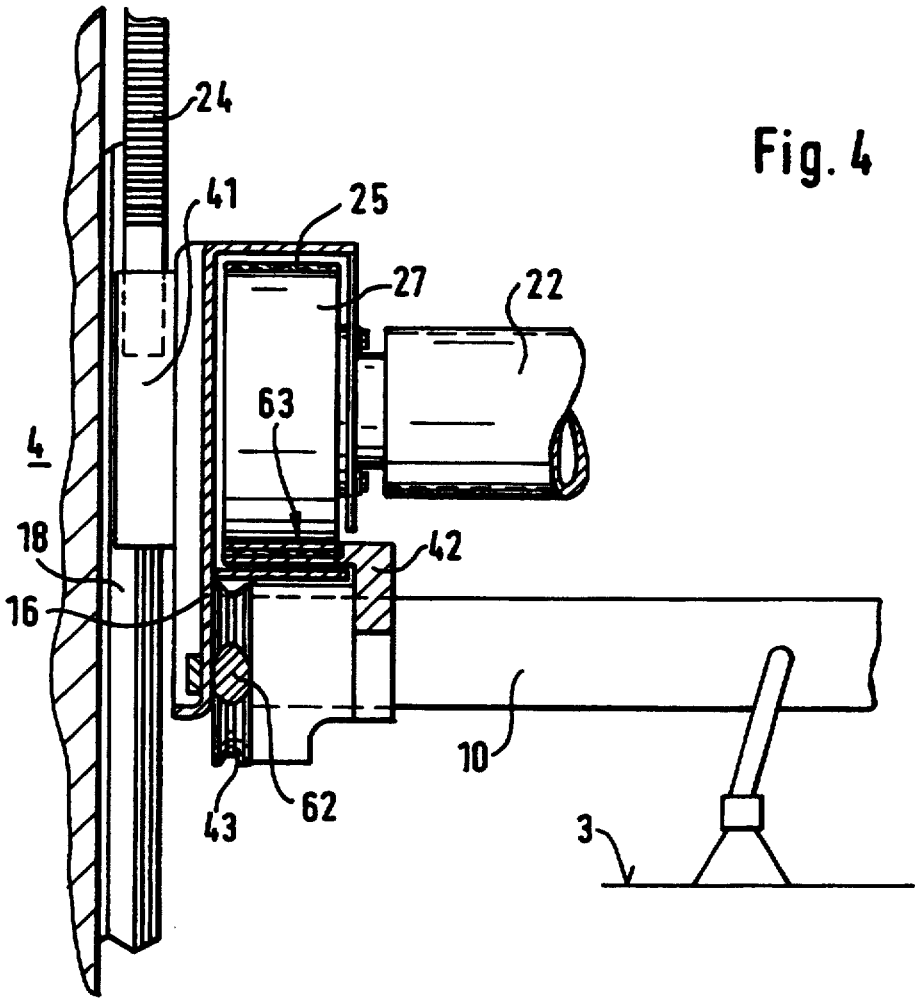
FIG. 4 is a sectional view corresponding to section IV—IV of FIG. 1.

The press stands 4 have one vertically extending guide 18 respectively in which, as illustrated in FIG. 4, a guiding carriage 41 can be lifted and lowered. Each of the transfer devices 8, 9 also comprises one guide strip 16 which is assigned to either the two left or two rearward press stands 4 and one guide strip 17 which is assigned to either the two right or two forward press stands 4, respectively. Therefore, guide strip 16 is situated behind the tool and the slide 2, and guide strip 17 is situated in front of the tool and the slide 2. The guide strips are rigidly connected with the pertaining guide carriage 41. On each guide carriage 41, one toothed rack 24 respectively is fastened which is guided in parallel to the vertical guides 18. The guide strips 16, 17 may be in one piece and thus extend along the whole length of the tool movement through the press 1.

When a transfer device 8, 9 is used as the insertion feeder (insertion device) or as the removal feeder (removal device), these are assigned to the forward insertion area or to the rearward insertion area. The guide strips 16, 17 may be divided and may therefore receive only one transport device 25, 26. The guide strips 16, 17 extend along the whole transport path of the sheet metal parts 3 in the press 1 and, in the case of a division of these strips in certain embodiments, along a partial path. Each of the guide strips 16, 17 has a horizontally extending longitudinal guide 62 for the guiding of holding devices 10, 11 via runners 43. Deflection rollers 27, 28 are rotatably disposed in each of the guide strips 16, 17, the deflecting roller 28 being rotationally driven by an adjusting device 13, 14 (second adjusting device). The adjusting devices 13, 14 may have servomotors 29, 31, 33 which, via transmissions 30, 32, 34 and the deflecting rollers 28 drive toothed belts 25, 26, which are guided around deflecting rollers 27, 28, or transport devices of that type to carry out a reciprocating horizontal movement. The holding devices 10, 11 for the transfer of the sheet metal parts 3 in the passage direction 15 through the press 1 may be active tongs, passive tongs or, as illustrated, traverses 10, 11 equipped with magnets or suction devices. Via driving devices 42, the traverses 10, 11 are fastened on both ends on one of the transport devices 25, 25 and 26, 26 respectively.

Figure 3:
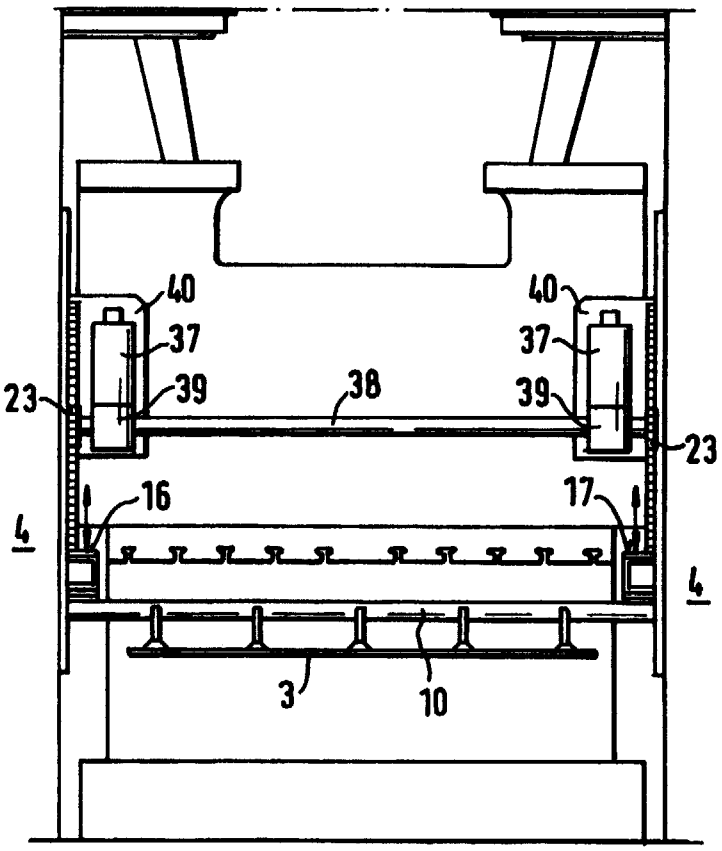
FIGS. 2 and 3 are lateral views respectively of the press of FIG. 1 in the passage direction.

In FIGS. 2 and 3, parts identical to those in FIGS. 1 and 4 have the same reference numbers. FIG. 2 illustrates a supporting plate 36 which is mounted to be fixed to the press 1 and on which a first adjusting device 19 is fastened for the lifting and lowering of the guide strips 16, 17 and of the structural members connected with these guide strips 16, 17. The movement of the first adjusting device 19 constructed, example, as a servomotor, is transmitted via a transmission 21 to a horizontally extending torsion bar 22, on whose two ends gearwheels 23 are rigidly fastened which engage in the toothed racks 24 and which interact with them.

FIG. 3 illustrates another embodiment having two supporting plates 40 fixed to the press for a first adjusting device 37 respectively which is a servomotor which acts via a transmission 39 on the gearwheel 23 which is in each case assigned next. The gearwheels 23 and the transmission 39 are connected with one another by a torsion bar 38. In the same manner, the transmissions 30, 32 and the driven deflecting rollers 28 in FIG. 1 are also connected with one another via a torsion bar 20.

The transfer devices 8, 9 in FIG. 1 are arranged behind one another so that a gap will exist between the transport devices/toothed belts 25, 26. According to FIG. 5, this gap is situated between the mutually facing deflecting rollers 27 of the toothed belts 25 and 26. For bridging this gap, the driving devices 42 between the fastening area 63 on the toothed belt 25, 26 and the fastening area 64 of the holding device 10, 11 are selected to be correspondingly long. The driving device 42 on toothed belt 25 and the driving device 42 on toothed belt 26 are directed against one another.

Figure 5:
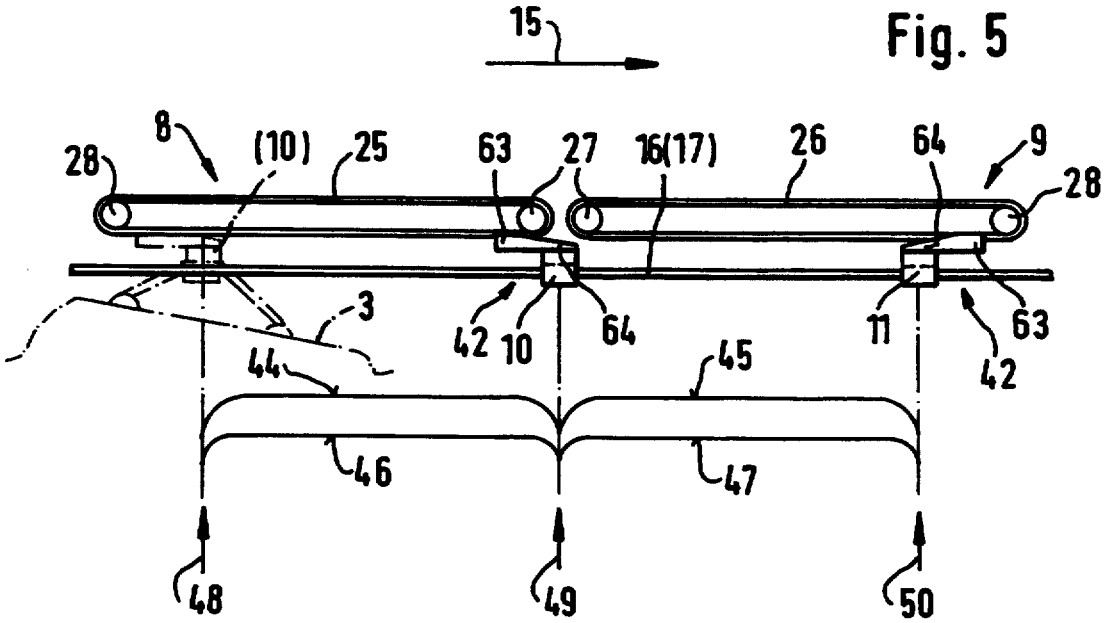
FIG. 5 is a schematic drawing of the two transfer devices of FIG. 1.

As seen in FIG. 5, the transfer movement of the sheet metal parts 3 in the passage direction 15 starts with the removal, in a lifting motion, of a sheet metal part 3 from a removal position 48, which may be a depiling station or an orientation station for the sheet metal part 3, or from an intermediate depositing device for the sheet metal part 3. This lifting motion is generated by the first adjusting devices 19, 21 or 37, 39. This is followed by a transfer movement 44 with a final lowering movement, for example, into the machining position 49, orientation station or on the intermediate depositing device. The transfer movement 44 is generated by the second adjusting device 13. In the same manner, the sheet metal part 3 situated in position 49 is moved by means of a transfer movement 45 into position 50 and is sent off. This position 50 may be a machining station, an intermediate depositing device, or a conveyor belt. The return movements of the holding devices 10, 11 have the reference numbers 46, 47.

Figure 6:
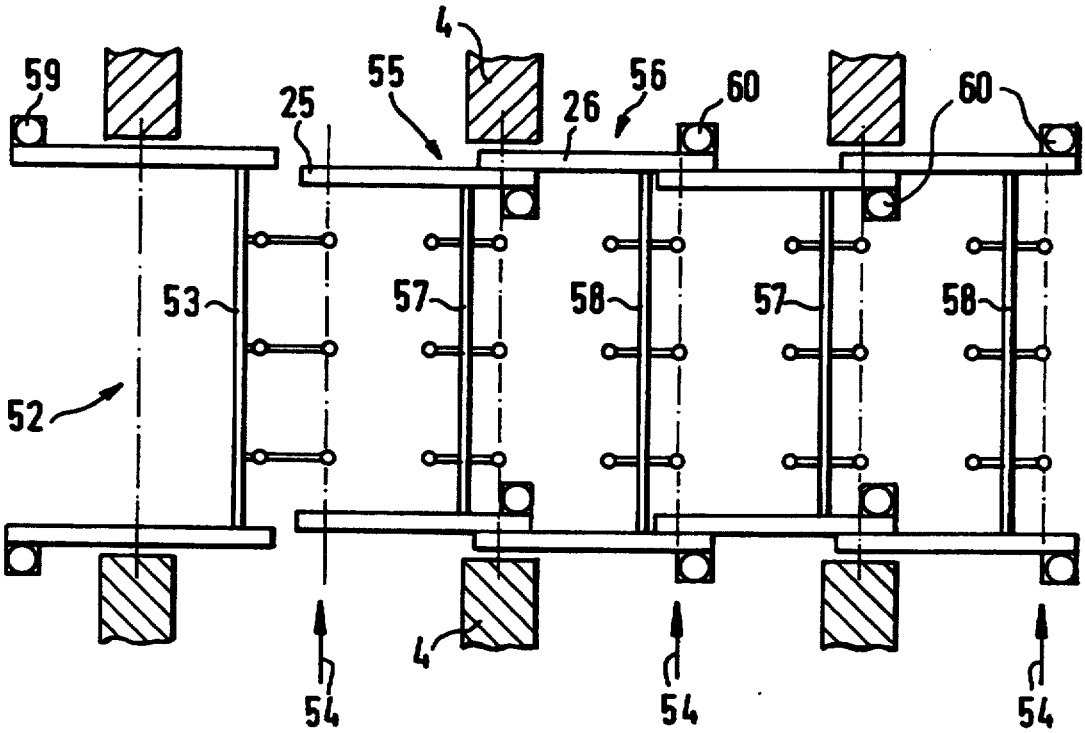
FIG. 6 is a top view of successively arranged transfer devices corresponding to FIGS. 1 to 4.
Figure 7:
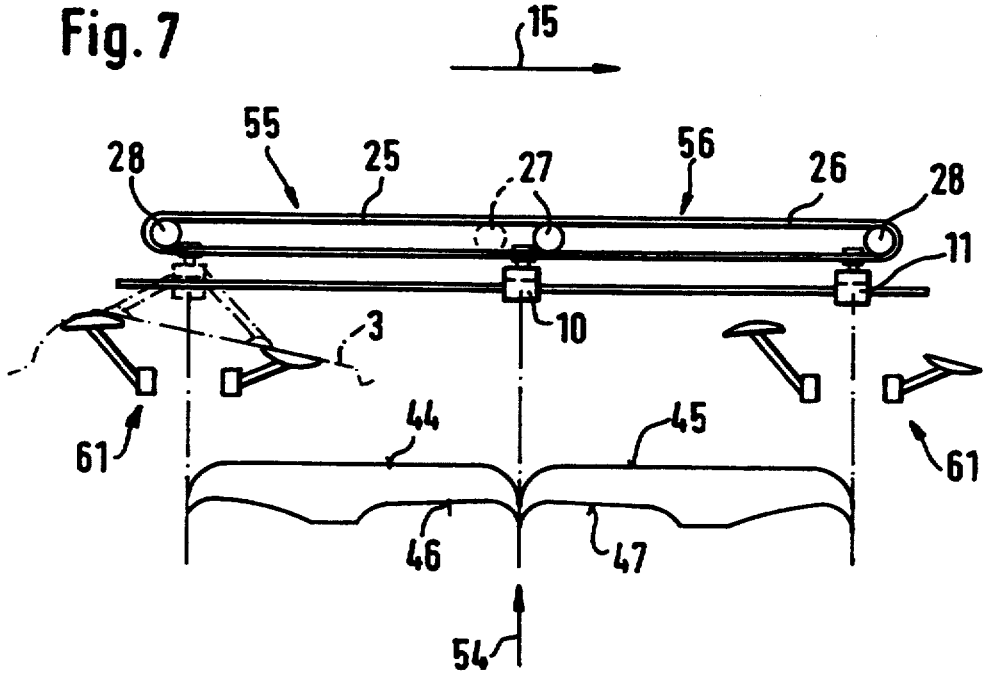
FIG. 7 is a schematic drawing of two transfer devices corresponding to FIG. 6.

For equipping a press, such as a multistand press, in the manner of press 1 and, as outlined, press 51 with additional (multiple die) presses in FIG. 1, corresponding to FIGS. 6 and 7, a previously used insertion feeder may be replaced by a transfer device 52 of the above-described modular construction. The traverse 53, which is equipped with magnets or suction cups, if necessary, for the bridging of larger distances, for example, for the insertion into the first machining step 54, is to have a lengthened construction. The transfer devices 55 and 56 have the above-explained construction. By means of the overlapping arrangement of the transport devices 25, 26 and as a result of the lateral offset of these transport devices with respect to one another, the gap described with respect to FIG. 5 between the deflecting rollers 27 is avoided. The holding devices 57, 58 which, for example, are also constructed as suction bars, have correspondingly different lengths. Reference numbers 59, 60 indicate second adjusting devices for the transfer movement 44, 45 of the sheet metal parts 3. Reference number 61 indicates intermediate depositing devices for an intermediate depositing of half the transport path at approximately half the distance between the machining stages 54.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A press, comprising:

a press frame;

at least one vertically movable press slide that forms sheet metal parts while interacting with tools;

an least one transfer device with holding devices which hold and transfer the sheet metal parts through movement of the holding devices vertically and horizontally along a passage direction, each transfer device including:

at least one transport device extending in the passage direction;

vertically movable horizontal guide strips in the press frame which extend at least along a partial length of a transfer movement of the sheet metal parts and extend in front of and behind the tool or the press slide, the holding devices being displaceable in the guide strips, and each of the guide strips having structural members which receive, bear and guide the transport device;

vertical guides coupled to the press frame and the guide strips;

a first adjusting device coupled to the guide strips and which lifts and lowers the guide strips in the vertical guides; and a second adjusting device, separate from the first adjusting device, coupled to the transport device and which moves the transport device to thereby move the holding devices along the passage direction;

wherein a plurality of the transfer devices are provided, with one transfer device respectively with at least one holding device provided for each transfer movement of the sheet metal parts from a removal position to a depositing position.

2. A press according to claim 1, wherein each of the transfer devices has, for each transport device, a second adjusting device which can be acted upon separately, all of the second adjusting devices of a transfer device being synchronously controllable.

3. A press according to claim 1, wherein the holding devices are traverses which are aligned transversely with respect to the passage direction and horizontally, and include retention devices for the sheet metal parts arranged on the traverses, the traverses being fastened by driving devices on mutually opposite transport devices.

4. A press according to claim 1, wherein the driving devices of one transfer device respectively are connected with one another via a torsion bar for the transfer movement.

5. A press according to claim 1, wherein each transfer device has a transport device for each guide strip which is guided around on deflecting rollers of which one deflecting roller can be driven by a further adjusting device.

6. A press according to claim 1, wherein each of the guide strips includes a longitudinal guide for the horizontal guiding and displacing of the holding device;

each of the guide strips is disposed in a vertical guide so that it can be lifted and lowered via an adjusting device fixed to the press, and wherein the lifting-lowering movement takes place via a gearwheel-toothed rack transmission comprising a toothed rack fastened on the guide strip the first adjusting device and gearwheels that are disposed at a distance opposite one another and connected with one another via a torsion bar.

7. A press according to claim 1, wherein the transport devices are in alignment with one another in the longitudinal course in the passage direction of successively arranged transfer devices the driving device being lengthened between a fastening area of the driving device on the transport device and a fastening area for the holding device.

8. A press according to claim 1, wherein the transfer devices are successively arranged in a passage direction, the transport devices being laterally offset with respect to one another and in an overlapping manner, whereby transfer lengths of the transport devices overlap with one another.

9. A press according to claim 1, wherein one of said transfer devices is provided as an insertion feeder with a suction bar and is connected in front of a first transfer device of the press.

10. A press according to claim 1, wherein one of said transfer devices is provided as a removal feeder with a suction bar and is connected behind a last transfer device of the press.

* * * * *